US008382397B2

(12) United States Patent
Perpezat et al.

(10) Patent No.: US 8,382,397 B2
(45) Date of Patent: Feb. 26, 2013

(54) HYDRAULICALLY-DRIVEN VIBRATING DEVICE FOR A VIBRATORY COMPACTING MACHINE

(75) Inventors: Daniel Perpezat, Rueil-Malmaison (FR); Laurent Pivert, Rueil-Malmaison (FR); Philippe Chagnot, Rueil-Malmaison (FR)

(73) Assignee: Soletanche Freyssinet, Rueil-Malmaison (FR)

( * ) Notice: Subject to any disclaimer, the term of this patent is extended or adjusted under 35 U.S.C. 154(b) by 0 days.

(21) Appl. No.: 13/146,832

(22) PCT Filed: Jan. 14, 2010

(86) PCT No.: PCT/FR2010/050055

§ 371 (c)(1),
(2), (4) Date: Sep. 19, 2011

(87) PCT Pub. No.: WO2010/086537

PCT Pub. Date: Aug. 5, 2010

(65) Prior Publication Data

US 2011/0318103 A1 Dec. 29, 2011

(30) Foreign Application Priority Data

Jan. 30, 2009 (FR) ..... 09 50621

(51) Int. Cl.
*E01C 19/02* (2006.01)
*E02D 3/02* (2006.01)

(52) U.S. Cl. ..... 404/115; 404/133.05

(58) Field of Classification Search ..... 404/102, 404/113, 133.05–133.2; 405/129.15, 232, 405/239, 302.4; 173/161.1, 161.2
See application file for complete search history.

(56) References Cited

U.S. PATENT DOCUMENTS

| | | | | |
|---|---|---|---|---|
| 2,340,959 | A * | 2/1944 | Harth | 166/301 |
| 2,717,763 | A * | 9/1955 | Bodine, Jr. | 175/55 |
| 3,309,877 | A * | 3/1967 | Degen | 405/271 |
| 4,086,970 | A * | 5/1978 | Kato | 173/162.1 |
| 4,397,588 | A * | 8/1983 | Goughnour | 405/236 |
| 6,554,543 | B2 * | 4/2003 | Hodge | 405/271 |
| 2002/0003989 | A1 | 1/2002 | Hodge | |

FOREIGN PATENT DOCUMENTS

| | | | |
|---|---|---|---|
| DE | 102 32 314 | A1 | 2/2004 |
| DE | 20 2007 012140 | U1 | 11/2007 |

OTHER PUBLICATIONS

International Search Report & Written Opinion mailed Jul. 5, 2010 of PCT/FR2010/050055.

* cited by examiner

*Primary Examiner* — Raymond W Addie
(74) *Attorney, Agent, or Firm* — Kenyon & Kenyon LLP

(57) ABSTRACT

The invention relates to a vibrator device for a vibratory compacting machine, said device comprising: a tubular body extending longitudinally and having a bottom end; at least one first hydraulic motor disposed in the tubular body and comprising a rotor and a stator; an eccentric member arranged inside the tubular body between the bottom end and the first hydraulic motor, said eccentric member being adapted to be rotated by the rotor of the first hydraulic motor so as to generate vibration. The invention is characterized in that the stator of the first hydraulic motor is constituted by the tubular body.

11 Claims, 6 Drawing Sheets

HYDRAULICALLY-DRIVEN VIBRATING DEVICE FOR A VIBRATORY COMPACTING MACHINE

This is a 371 national phase application of PCT/FR2010/050055 filed 14 Jan. 2010, claiming priority to French Patent Application No. 0950621 filed 30 Jan. 2009, the contents of which are incorporated herein by reference.

BACKGROUND OF THE INVENTION

The present invention relates to the field of treating the ground by vibration compacting.

The vibration compacting technique consists in causing a penetration unit to penetrate vertically into the ground, which unit comprises a vibrator device connected to a carrier via a plurality of tubes having substantially the same diameter as the vibrator device.

When the penetration unit penetrates into the ground, the vibrator device generates radial vibration that diffuses through the ground, with the effect of improving its mechanical properties. For example, the technique is used for compacting a volume of ground that is constituted, for example, of grains, such as sand.

More precisely, the invention relates a vibrator device for a vibration compacting machine, said device comprising:

- a tubular body extending longitudinally while presenting a bottom end;
- at least a first hydraulic motor disposed in the tubular body and comprising a rotor rotatably mounted in a stator-forming casing; and
- an eccentric member arranged inside the tubular body between the bottom end and the first hydraulic motor, said eccentric member being designed to be driven in rotation by the rotor of the first hydraulic motor in order to produce vibration.

The hydraulic motor fitted to such a vibrator device comes from a conventional commercially-available range of motors.

The motor used in the prior art consists of a rotor and a stator that form an assembly that is distinct from the other elements of the vibrator device, and in particular from the tubular body.

During assembly, the motor assembly is placed in the tubular body in order to connect the eccentric member to the rotor. Conventionally, the rotor is the portion of the motor that is mounted to rotate in the casing of the motor.

Such vibrators are described in particular in Documents US 2002/003989 and DE 102 32 314, in which the motor assembly constitutes a unit that is distinct from the remainder of the vibrator device, and in particular from the tubular body.

A drawback of that configuration is that it makes it necessary to use hydraulic motors of small cylinder capacity, and thus presenting low power.

One of the constraints on vibrator devices is that they must penetrate easily into the ground. To do this, it is desirable to minimize the diameter of the tubular body. Penetration into the ground is made easier by a tubular body that is fine.

That is why it is desired to build vibrator devices that present a diameter that is as small as possible, typically of the order of 300 millimeters (mm).

As a result, the volume available for the hydraulic motor is limited. The penetration capacity of the vibrator device is thus generally obtained to the detriment of the power of its hydraulic motor.

It is why certain manufacturers are discarding the hydraulic solution and prefer to use an electric motor having component elements that can present a length that is longer relative to their diameter.

OBJECT AND A SUMMARY OF THE INVENTION

An object of the invention is to propose a hydraulically-driven vibrator device that remedies the above-mentioned drawbacks.

The invention achieves this object by the fact that the casing of the first hydraulic motor is constituted by the tubular body.

The advantage is to be able to avoid using a stator-forming casing for the hydraulic motor when the motor is taken from a commercially-available range, such that in the invention the volume that is available for the rotor is greater than in the prior art, and as a consequence the cylinder capacity of the hydraulic motor is advantageously increased, thereby increasing the maximum power it can deliver.

In other words, in the invention, the original casing of the motor used in prior art vibrator devices is omitted.

Thus, in the volume defined inside the tubular body, it is advantageously possible to form a hydraulic motor that presents mechanical performance that is significantly better than that of existing vibrator devices.

Advantageously, the first hydraulic motor further includes at least one bearing arranged between the rotor and an inside surface of the tubular body.

This bearing, e.g. constituted by a ball bearing, serves to guide the rotor in rotation relative to the inside surface of the tubular body.

Preferably, but not necessarily, the bearing is blocked axially relative to the tubular body by means of a shoulder formed on the inside surface of the tubular body.

In a first embodiment, the bearing bears directly against the inside surface of the tubular body.

In its first embodiment, the volume available for the rotor is maximized, since there is no part between the ball bearing and the tubular body.

In a second embodiment, the vibrator device of the invention further includes a sleeve arranged between the bearing and the inside surface of the tubular body.

Preferably, the sleeve includes a sealing member for providing sealing between the rotor and the eccentric member.

Preferably, the sleeve also extends axially towards the eccentric member in such a manner as to define a housing for a connection part between the shaft of the rotor and the eccentric member.

In a variant of the second embodiment of the invention, the tubular body is constituted by a first portion in which the eccentric member is housed, and a second portion, distinct from the first portion, in which at least a portion of the rotor of the first hydraulic motor is housed, the first portion being securely fastened to the second portion by means of the sleeve.

It can thus be understood that by means of the sleeve it is possible to remove the first portion of the tubular body without moving or dismantling the first hydraulic motor.

One advantage is to be able to change the eccentric member, possibly together with the first portion of the tubular body, in the event of these parts being damaged.

Advantageously, the first hydraulic motor further includes a yoke mounted at one longitudinal end of the rotor, said yoke having a diameter that is substantially equal to the inside diameter of the tubular body.

The yoke is the part of the hydraulic motor that enables the rotor to be powered with hydraulic energy.

The yoke of the invention makes it possible to achieve sealing between the top portion of the tubular body and the chamber that is defined radially between the rotor and the inside face of the tubular body. This configuration is particularly advantageous when the vibrator device of the invention does not have a sleeve.

Preferably, the peripheral edge of the yoke bears axially against a shoulder formed in the inside face of the tubular body.

In a third embodiment, the vibrator device further includes a second hydraulic motor arranged inside the tubular body while being designed to be coupled to the first hydraulic motor.

Thus, in the invention, the second hydraulic motor may optionally be coupled to the first hydraulic motor, thus making it possible advantageously to modify the frequency of the vibration generated by the vibrator device.

When the two motors are mechanically coupled together, the resulting assembly presents a cylinder capacity that is larger, and thus enables greater power to be delivered than if the first hydraulic motor were the only motor in operation. As a result, for a given hydraulic fluid flow rate, the eccentric member turns more slowly and generates vibration at a lower frequency.

Preferably, the vibrator device further includes a distributor for feeding at least one of the two hydraulic motors.

By means of a distributor, it is thus possible to activate or deactivate the second hydraulic motor quickly in order to change the frequency of vibration quickly. The vibrator device of the invention is thus advantageously reactive.

Also preferably, the cylinder capacity of the first hydraulic motor is greater than the cylinder capacity of the second hydraulic motor.

This makes it possible to locate the second hydraulic motor between the first hydraulic motor and the distributor, the second hydraulic motor having hydraulic pipes for powering the first hydraulic motor passing along its sides.

The invention also provides a vibration compacting machine comprising:

- a vibrator device of the invention;
- means for feeding hydraulic energy to the vibrator device; and
- a movable structure supporting the vibrator device in a substantially vertical direction.

BRIEF DESCRIPTION OF THE DRAWINGS

The invention can be better understood on reading the following description given by way of nonlimiting indication with reference to the accompanying drawings, in which.

DETAILED DESCRIPTION OF THE INVENTION

Figure 1:
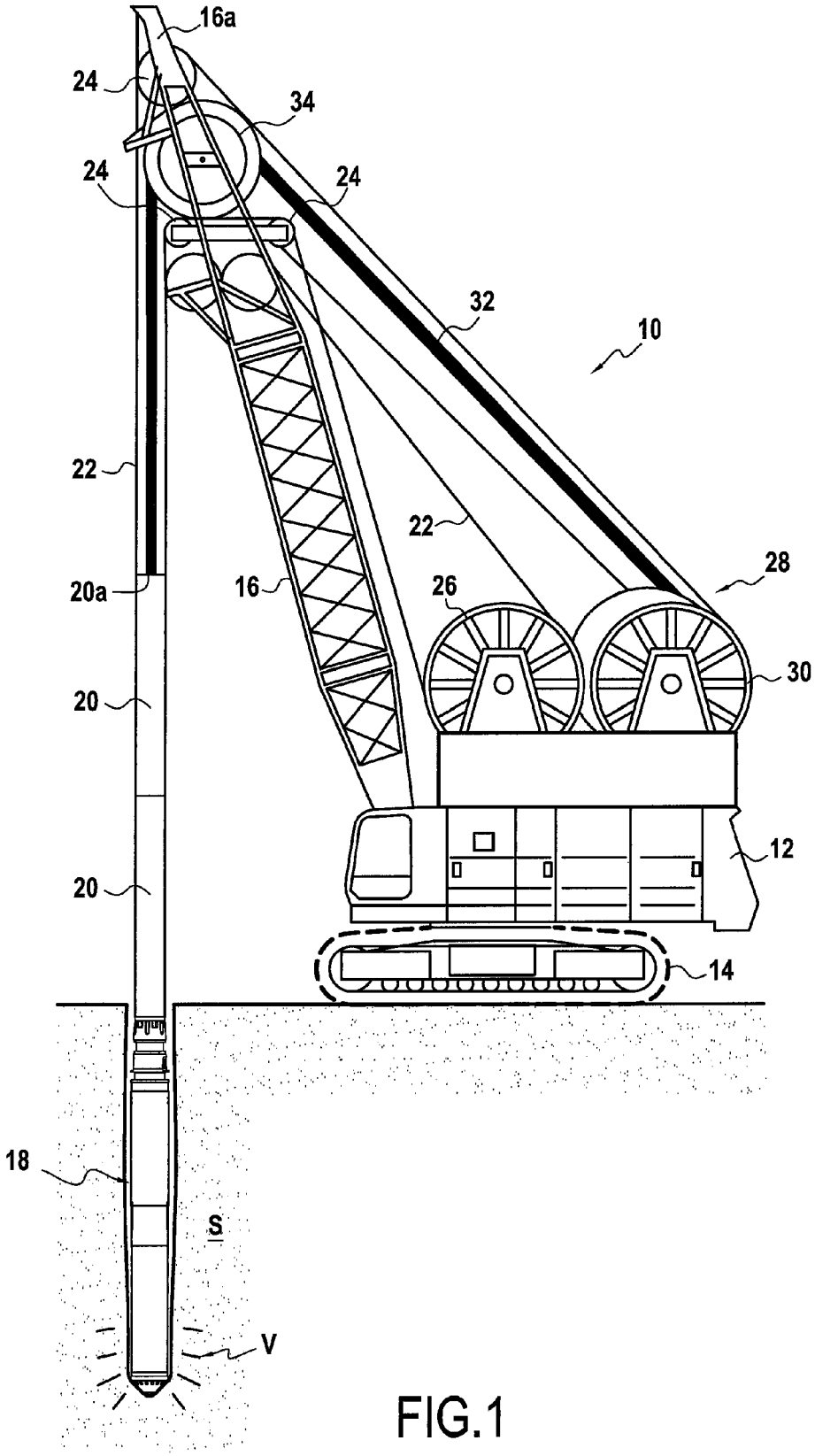
FIG. 1 shows a vibration compacting machine of the invention, in which the vibrator device is engaged in the ground.

FIG. 1 shows an example of a vibration compacting machine 10 of the invention that is used in this configuration for performing a vibration compacting operation.

This machine 10 comprises a structure 12 mounted on crawler tracks 14 to enable it to move, together with a jib 16 extending upwards from the structure 12.

More precisely, the machine 10 further includes a vibrator device 18 mounted at the bottom end of a plurality of vertically-oriented tubes 20, being carried by the end 16*a* of the jib 16.

The vibrator device 18 is in the form of a long narrow cylinder of length that is long compared with its diameter, the bottom end of the vibrator device presenting a head to facilitate penetration into the ground.

Because of its particular shape, the vibrator device 18 is suitable for penetrating into soft ground, such as sand, generally solely under the effect of the force of gravity. Nevertheless, if necessary, it is possible to apply an additional vertical force (commonly referred to as "pull down").

The top end 20*a* of the set of tubes 20 is fastened to a cable 22 that is guided by a set of pulleys 24 disposed at the end 16*a* of the jib 16.

In this example, the cable 22 is moved by a motor-driven winder 26 mounted on the structure 12. It can be understood that the cable 22 serves to raise the vibrator device and also to guide its descent.

The machine 10 also includes means 28 for feeding the hydraulic motor of the vibrator device 18 with a hydraulic energy. Specifically, these means 28 comprise a winder 30 of hydraulic hoses 32, together with a hydraulic energy source (not shown).

As can be seen in FIG. 1, the hydraulic hoses 32 are conveyed via a pulley 34 situated at the end 16*a* of the jib towards the vibrator device 18, by extending inside the tubes 20.

When the vibrator device 18 penetrates into the ground S, it generates vibration V that diffuses into the ground.

Naturally, FIG. 1 is diagrammatic, it being possible for the vibrator device 18 to reach a depth of the order of several tens of meters.

Figure 2:
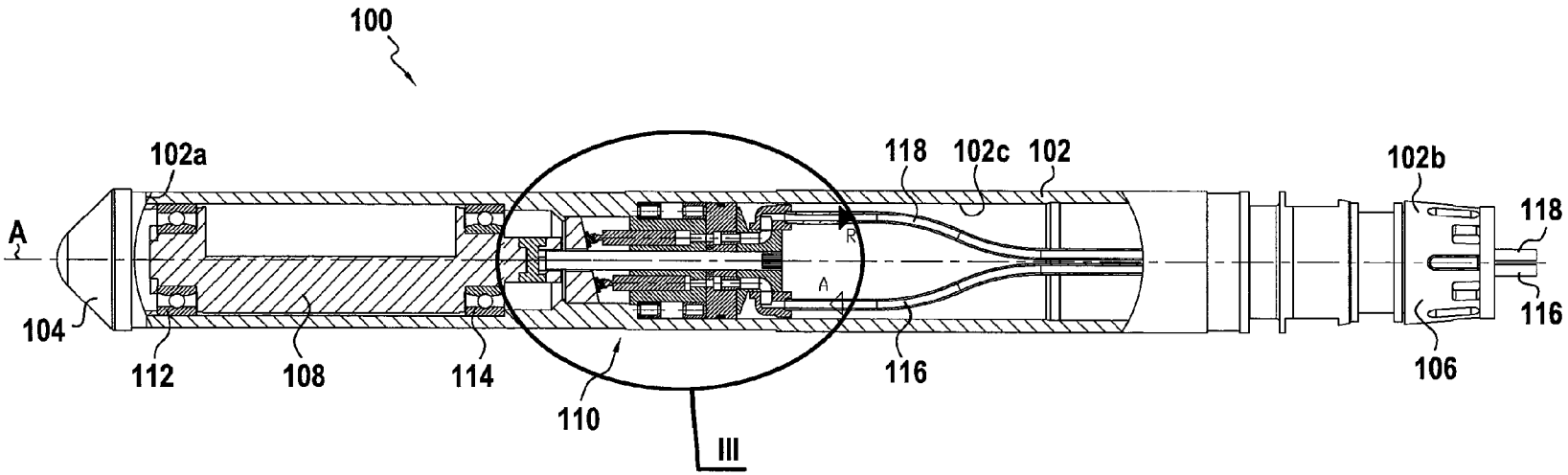
FIG. 2 is an axial view in section of the vibrator device in a first embodiment of the invention.

With reference to FIG. 2, there follows a more detailed description of a vibrator device 100 in a first embodiment of the invention.

As can clearly be seen in this axial section view, the vibrator device 100 comprises a tubular body 102 extending longitudinally along the axis A of the vibrator device 100. The tubular body 102 presents a bottom end 102*a* and a top end 102*b*. The bottom end 102*a* of the tubular body 102 carries a rounded head 104 suitable for facilitating penetration of the vibrator device 100 into the ground, while the top end 102*b* presents a coupling member 106 for fastening to the bottom end of the above-mentioned set of tubes 20. Furthermore, the tubular body 102 presents an inside surface 102*c* that is cylindrical in this example.

In order to generate vibration, the vibrator device 100 further includes an eccentric member 108 for being driven in rotation about the axis A by a hydraulic motor 110. The eccentric member 108 is itself known and in this example it is in the form of a cylinder having a hollowed-out section. This eccentric member 108 is held and guided at each of its ends by respective ball bearings 112 and 114.

The hydraulic motor 110 is conventionally powered by at least two hydraulic pipes 116 and 118 that extend axially in continuity from the hydraulic hoses 32. Three hydraulic pipes are needed if the draining function is performed by a separate pipe.

Figure 3:
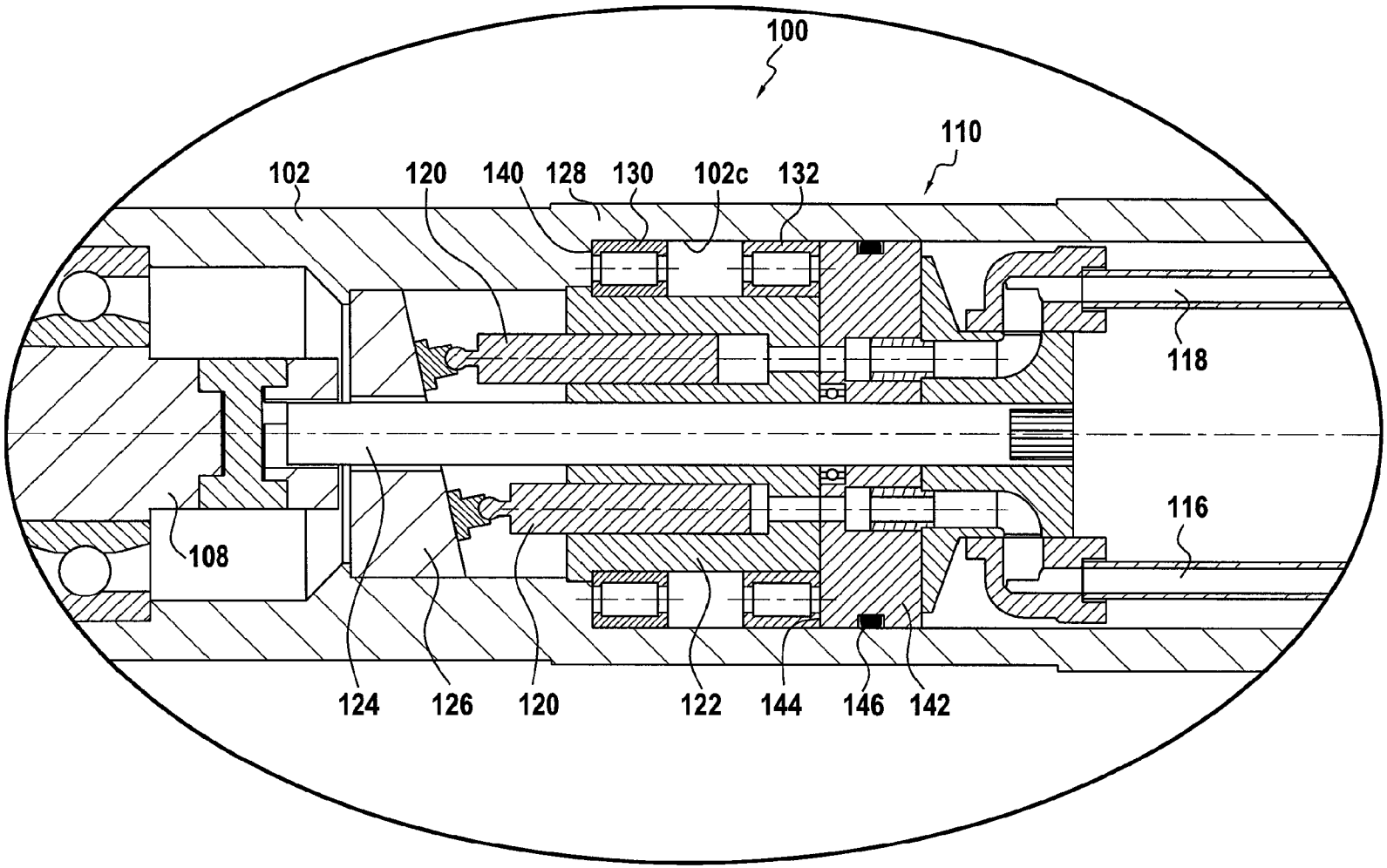
FIG. 3 is a detail view of the FIG. 2 vibrator device, showing the arrangement of the hydraulic motor.

With reference to FIG. 3, there follows a more detailed description of the hydraulic motor 110 of the vibrator device 100 in its first embodiment.

This hydraulic motor 110, is specifically a motor of the type having axial pistons 120, and it comprises a rotor 122 that is securely fastened to an axial transmission shaft 124, the transmission shaft being coupled to the eccentric member 108.

The rotor 122 is in the form of a drum, analogous to the cylinder of a pistol, and in which the axial pistons 120 can move axially.

In known manner, under the effect of hydraulic pressure, the axial pistons 120 move axially while bearing against a sloping cam 126, thereby causing them to rotate, and thus also causing the rotor 122 to rotate about the axis A.

As can be seen in FIG. 3, the stator 128 of the hydraulic motor 110 is advantageously constituted by the tubular body 102, thus making it possible for a given tubular body to have a rotor of a cylinder capacity that is greater than would be possible when using a complete commercially-available hydraulic motor, thereby obtaining greater power.

The rotor 122 is guided in rotation by two bearings 130 and 132 that are placed between the rotor 122 and the inside surface 102*c* of the tubular body 102. It should be observed that it would be entirely possible to use only the bearing 130, for example. More precisely, it is found in this embodiment that the bearings 130 and 132 bear directly against the inside surface 102*c*.

In this figure, it can also be seen that the bearing 130 bears against a shoulder 140 formed in the thickness of the peripheral edge of the tubular body 102. It can thus be understood that the tubular body 102, acting as a stator, also serves to block the rotary elements of the hydraulic motor 110 in an axial direction.

Furthermore, the hydraulic motor 110 also includes a yoke 142 that is mounted at one of the longitudinal ends of the rotor 122, specifically at its top end 144. According to an advantageous aspect, the yoke 142 presents a diameter that is substantially equal to the inside diameter of the tubular body 102, thereby enabling the yoke 142, possibly assisted by a gasket 146, to provide sealing between the chamber containing the bearings 130 and 132, and the top end of the inside of the tubular body 102.

Figure 4:
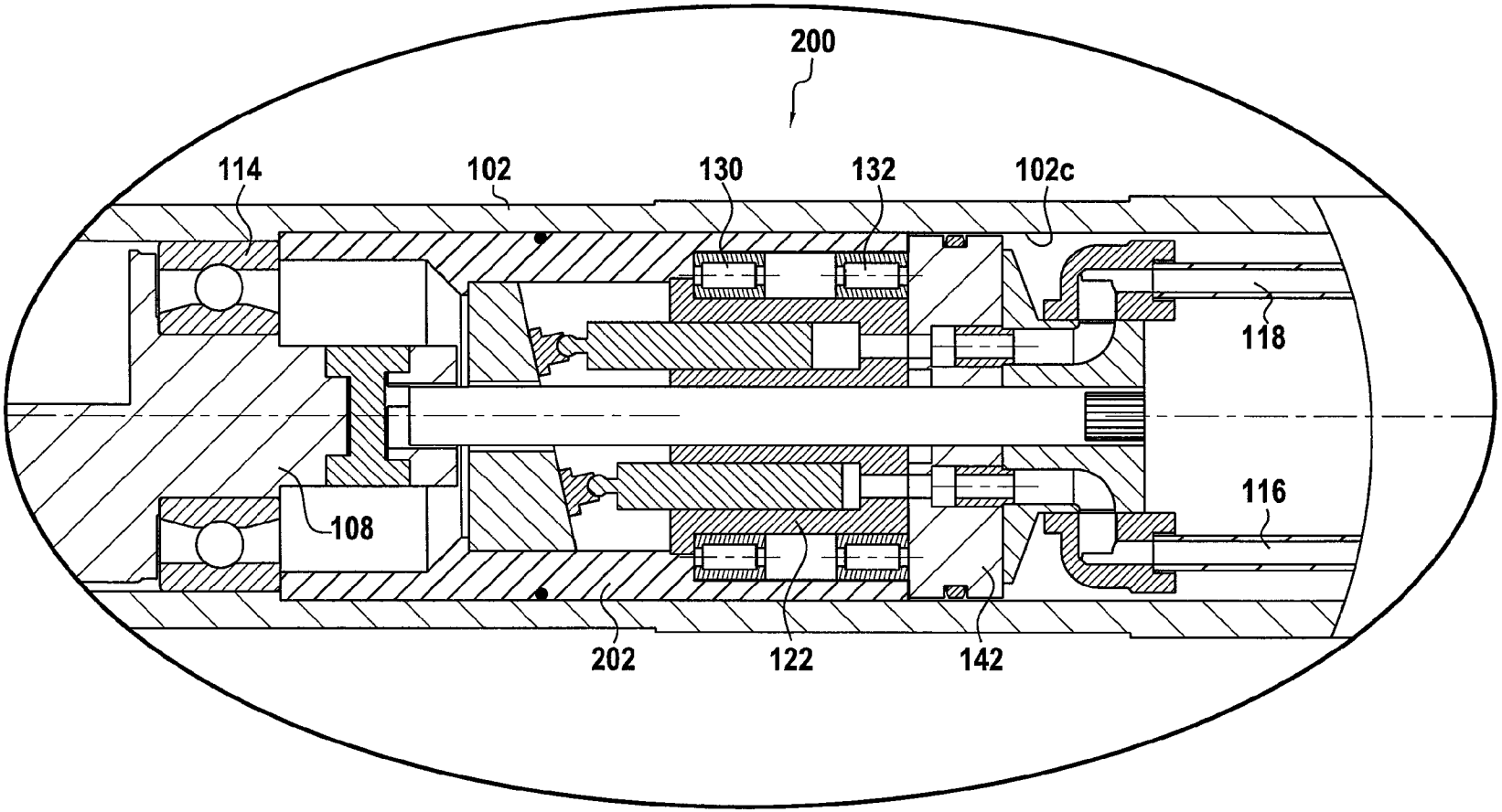
FIG. 4 is a detail view of the vibrator device in a second embodiment of the invention.

With reference to FIG. 4, there follows a description of a second embodiment of the vibrator device 200 of the invention.

This second embodiment of the vibrator device 200 differs from the first embodiment by the fact that it further includes a sleeve 202 of generally cylindrical shape that extends, in this example, axially between the bearings 114 of the eccentric member 108 and the yoke 142.

This sleeve 202 surrounds the rotor 122, being arranged radially between the bearings 130, 132 and the inside surface 102*c* of the tubular body 102.

Figure 5:
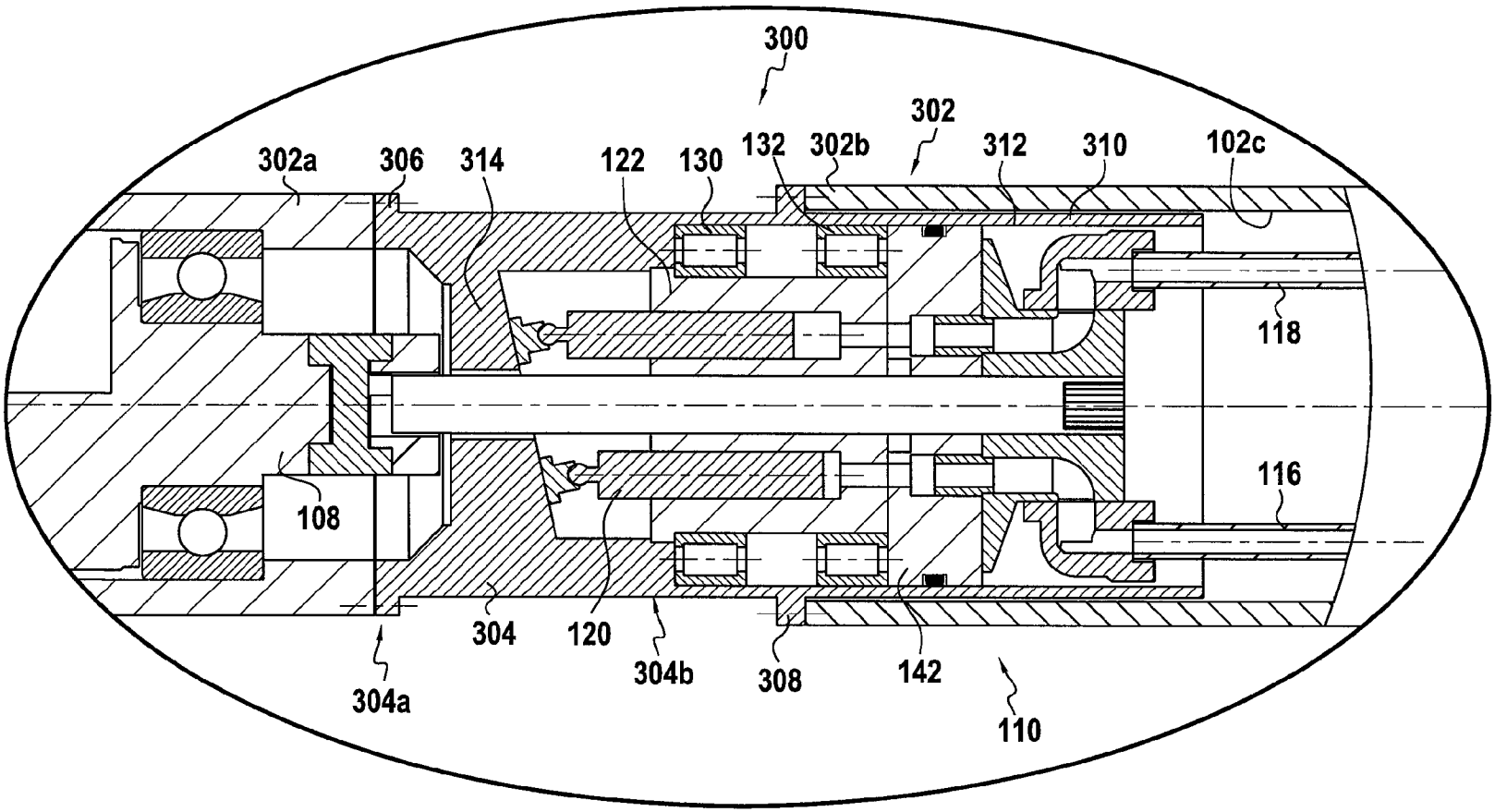
FIG. 5 is a detail view of the vibrator device in a variant of the second embodiment of the invention.

FIG. 5 shows a vibrator device 300 in a variant of the above-described second embodiment.

In this variant, the tubular body 302 is constituted by a first portion 302*a* and a second portion 302*b*, these two portions being distinct and preferably presenting substantially the same diameter.

As can be seen, the eccentric member 108 is housed in the first portion 302*a*, while the second portion 302*b* houses the hydraulic motor 110 and the hydraulic pipes 116 and 118.

The first portion 302*a* is fastened to the second portion 302*b* via a sleeve 304 similar to the above-described sleeve 202.

To do this, the sleeve 304 has first fastener means 306 located at a bottom end 304*a* of the sleeve 304 for fastening to the first portion 302*a*, and second fastener means 308 located on the outside surface 304*b* of the sleeve 304 for fastening it to the bottom end of the second portion 302*b* of the tubular body 302.

The sleeve 304 further includes a cylindrical portion 310 designed to be introduced into the second portion 302*b* of the tubular body 302. In order to do this, the outside diameter of said cylindrical portion 310 corresponds substantially to the inside diameter of the second portion 302*b* of the tubular body 302.

As can be seen in FIG. 5, the thickness of the wall 312 of the cylindrical portion 310 is selected to be quite thin in order to maximize the volume available for the rotor 122.

Furthermore, in this embodiment, the yoke 142 bears radially against the wall of the cylindrical portion 310.

In this variant, the sloping cam 314, against which the ends of the axial pistons 120 bear, is advantageously formed integrally with the sleeve 304.

By means of this configuration, it can be understood that is easy to change the eccentric member 108 and the rotor 122 by removing the sleeve 304.

Figure 6:
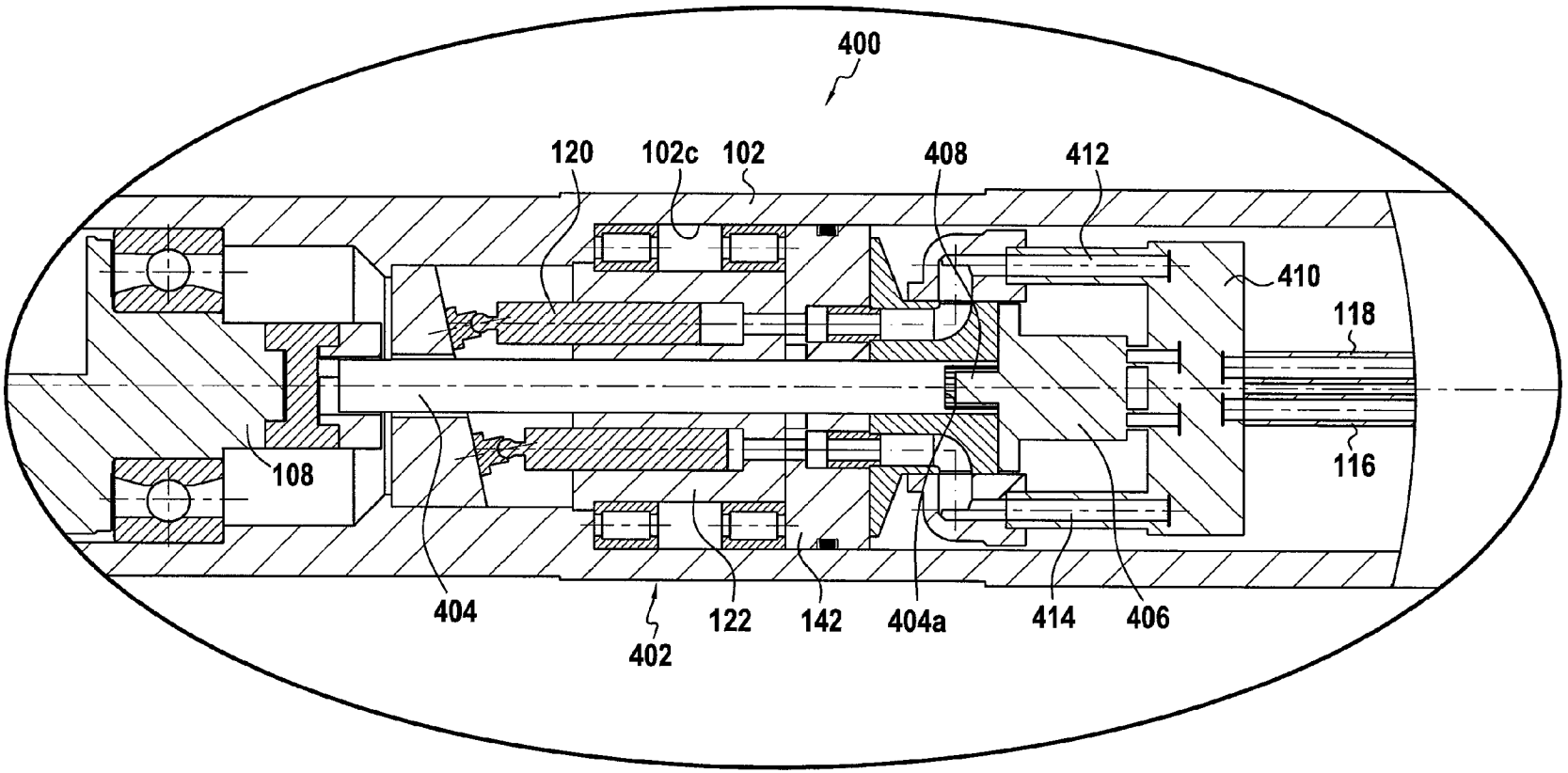
FIG. 6 is a detail view of the vibrator device in a third embodiment of the invention.

With reference to FIG. 6, there follows a description of the third embodiment of the vibrator device of the invention.

In this embodiment, the vibrator device 400 includes a first hydraulic motor 402 similar to the hydraulic motor 110 of the first embodiment, having its rotor 122 coupled to a transmission shaft 404, which shaft is connected to the eccentric member 108.

Advantageously, the vibrator device 400 further includes a second hydraulic motor 406 that is distinct from the first hydraulic motor 402 and that is coupled to the transmission shaft 404. As can be seen in FIG. 6, the outlet shaft 408 from the second hydraulic motor 406 also extends along the axis A and co-operates with the top end 404*a* of the transmission shaft 404.

According to the invention, the second hydraulic motor 406 is suitable for being coupled with the first hydraulic motor 402 so as to deliver additional power to the transmission shaft 404. This gives rise to a hydraulic flow rate corresponding to a reduction in the frequency of the vibration generated by the eccentric member 108.

In order to feed both hydraulic motors, the vibrator device 400 includes a distributor 410 that is connected firstly to the hydraulic pipes 116, 118, and secondly to each of the two motors.

The distributor 410 is controllable so that the operator can choose to activate or not activate the second hydraulic motor 406.

It can also be seen that the cylinder capacity of the second hydraulic motor is preferably smaller than the cylinder capacity of the first hydraulic motor 402, thus making it possible, in particular, for the feed pipes 412, 414 leaving the distributor for the purpose of feeding the first hydraulic motor to extend axially beside the second hydraulic motor.

By way of example, the second hydraulic motor 406 may be actuated on request in order, temporarily, to modify the frequency of the vibration that is generated.

The invention claimed is:

1. A vibrating device for a vibratory compacting machine, said device comprising:

a tubular body extending longitudinally and having a bottom end;

at least one first hydraulic motor disposed in the tubular body and comprising a rotor rotatably mounted in a stator-forming casing; and an eccentric member arranged inside the tubular body between the bottom end and the first hydraulic motor, said eccentric member being adapted to be rotated by the rotor of the first hydraulic motor so as to generate vibration;

wherein the casing of the first hydraulic motor is formed by the tubular body.

2. A vibrating device according to claim 1, wherein the first hydraulic motor further comprises at least one bearing arranged between the rotor and an inside surface of the tubular body.

3. A vibrating device according to claim 2, wherein the bearing bears directly against the inside surface of the tubular body.

4. A vibrating device according to claim 2, further comprising a sleeve arranged between the bearing and the inside surface of the tubular body.

5. A vibrating device according to claim 4, wherein the sleeve comprises a sealing member for providing sealing between the rotor and the eccentric member.

6. A vibrating device according to claim 4, wherein the tubular body is constituted by a first portion in which the eccentric member is housed, and a second portion, distinct from the first portion, in which at least a portion of the rotor of the first hydraulic motor is housed, and wherein the first portion is securely fastened to the second portion by the sleeve.

7. A vibrating device according to claim 1, wherein the first hydraulic motor further comprises a yoke mounted at one longitudinal end of the rotor, said yoke having a diameter that is substantially equal to the inside diameter of the tubular body.

8. A vibrating device according to claim 1, further comprising a second hydraulic motor arranged inside the tubular body said second hydraulic motor being adapted to be coupled to the first hydraulic motor.

9. A vibrating device according to claim 8, further comprising a distributor for feeding at least one of the two hydraulic motors.

10. A vibrating device according to claim 8, wherein the cylinder capacity of the first hydraulic motor is greater than the cylinder capacity of the second hydraulic motor.

11. A vibratory compacting machine comprising:

a vibrating device according to claim 1;

a device for feeding hydraulic energy to the vibrating device; and a movable structure supporting the vibrating device in a substantially vertical direction.

* * * * *